US005979124A

United States Patent [19]

Branan

[11] Patent Number: 5,979,124

[45] Date of Patent: Nov. 9, 1999

[54] DOOR SYSTEM FOR COLUMBARIUM

[75] Inventor: Kyle Branan, Elberton, Ga.

[73] Assignee: Everlasting Granite Memorial Co., Elberton, Ga.

[21] Appl. No.: 09/102,221

[22] Filed: Jun. 22, 1998

[51] Int. Cl.[6] ..... E04H 13/00

[52] U.S. Cl. ..... 52/136; 52/134; 52/511; 52/483.1; 52/489.1

[58] Field of Search ..... 51/136, 134, 511, 51/483.1, 489.1

[56] References Cited

U.S. PATENT DOCUMENTS

| | | | |
|---|---|---|---|
| 2,853,870 | 9/1958 | Sinner et al. | 72/19 |
| 3,213,576 | 10/1965 | Davies . | |
| 3,550,337 | 12/1970 | Lorenz . | |
| 3,754,805 | 8/1973 | Pangburn et al. . | |
| 3,878,656 | 4/1975 | Duwe et al. | 52/134 |
| 3,990,199 | 11/1976 | Gallo . | |
| 4,607,417 | 8/1986 | Hancovsky . | |
| 4,644,711 | 2/1987 | Eickhof . | |
| 4,928,467 | 5/1990 | Hintsa | 52/511 |
| 5,195,812 | 3/1993 | Eickhof . | |
| 5,287,603 | 2/1994 | Schorman . | |
| 5,740,637 | 4/1998 | Snow . | |
| 5,894,699 | 4/1999 | Fulton et al. | 52/132 |

*Primary Examiner*—Christopher T. Kent
*Assistant Examiner*—Nkeisha J. Maddox
*Attorney, Agent, or Firm*—Henry S. Jaudon; Cort Flint

[57] ABSTRACT

A columbarium which includes a pair of end walls disposed along substantially vertical planes resting on a base and supporting a top forming an enclosed open area. A plurality of containers which are arranged in horizontal and vertical rows are positioned within the open area. A pair of side walls which are supported solely by the base are disposed along substantially vertical planes forming the outer limits of the open area. The side walls are formed of a plurality of removable cover plates which are arranged in horizontal and vertical rows which substantially correspond with the horizontal and vertical rows formed by the containers.

12 Claims, 3 Drawing Sheets

DOOR SYSTEM FOR COLUMBARIUM

BACKGROUND OF THE INVENTION

This invention is directed to a columbarium in which the exposed structure is stone and all of the support or load bearing units are stone.

Columbariums are well know structures which are used for the storage of cremated remains. The standard for such structures includes horizontal and vertical rows of individual compartments arranged within a housing. The housing includes a plurality of doors which are hung to position one in front of each compartment. These doors are arranged to be individually removable so that any selected compartment may be exposed.

A drawback to these types of structures is that normally metal supports for the doors are exposed to the elements. U.S. Pat. No. 3,990,199 to Gallo show an example of this type of arrangement.

Another drawback of known structures which support the doors require special tools to open, close or position the doors. U.S. Pat. No. 4,644,711 to Eickhof shows an example of this type of structure.

Another known structure which individually supports the door structures is shown in U.S. Pat. 3,550,337 to Lorenz. This arrangement has no lock for the door.

All of the above arrangements require vertical and horizontal partitions within the columbarium as a part of the support structure.

Accordingly, an object of the invention is a columbarium having a plurality of cover plates in which each cover plate is supported by stone.

Another object of the invention is a columbarium structure with no exposed metal components.

Another object of the invention is the provision of a door system for a columbarium comprising a plurality of cover plates directly supported by the base structure.

Another object of the invention is a unique internal frame structure which maintains the cover plates positioned vertically of each other.

Another object of the invention is a locking system which restricts removal of the cover plates.

Another object of the invention is a columbarium formed with an open inner area devoid of partitions.

SUMMARY OF THE INVENTION

The instant invention is directed to a columbarium having a horizontal stone base, vertical stone end walls, and a stone top forming an opening which functions to house a plurality of containers. The containers are arranged side by side in vertical and horizontal rows. A pair of substantially vertically disposed side walls, which are supported on the base, are positioned within the opening adjacent the outer ends of the rows of containers. Each of the side walls comprise a plurality of removable stone cover plates which are arranged in side by side vertical and horizontal rows with each of the plates being positioned opposite an end of one of the containers. Each cover plate functions as an outer door for a respective container.

A support frame is positioned within the opening between the side walls and the container ends. The support frame comprises a plurality of interconnected horizontal rods and vertical struts which are arranged along planes which are substantially parallel with the horizontal and vertical sides of the containers. Opposing ends of at least certain of the rods and struts are connected with the inner faces of the ends, top and base. Each of the cover plates has a pair of attachment strips secured therewith which are adapted to attach with the frame to secure the cover plates along the vertical plane. The cover plates forming the lower of said horizontal rows are supported on the base. In each succeeding of the horizontal rows, the cover plates are supported on the cover plates forming the previous lower horizontal row.

Adjacent pairs of the horizontal rods are formed with oppositely directed flared edges. The attachment strips also are formed with oppositely directed flared edges. The flared edges of the strips are removably engageable behind the flared edges of the rods fixing the plates in vertical alignment opposite respective container ends and closing the opening.

The entire outer surface area of the columbarium, i.e., the end walls, the side walls and the top, are supported on or by the base. Each of these components are formed of stone, preferably granite, which provides for an extremely stable structure which is substantially free from the deterioration brought on by continuous exposure to the elements of nature.

DESCRIPTION THE DRAWINGS

The invention will be more readily understood from a reading of the following specification and by reference to the accompanying drawings forming a part thereof, wherein an example of the invention is shown and wherein:

FIG. 3A is an exploded sectional exploded side view of the door or cover plate forming the outer sides of the columbarium;

DESCRIPTION OF THE PREFERRED EMBODIMENT

Figure 1:
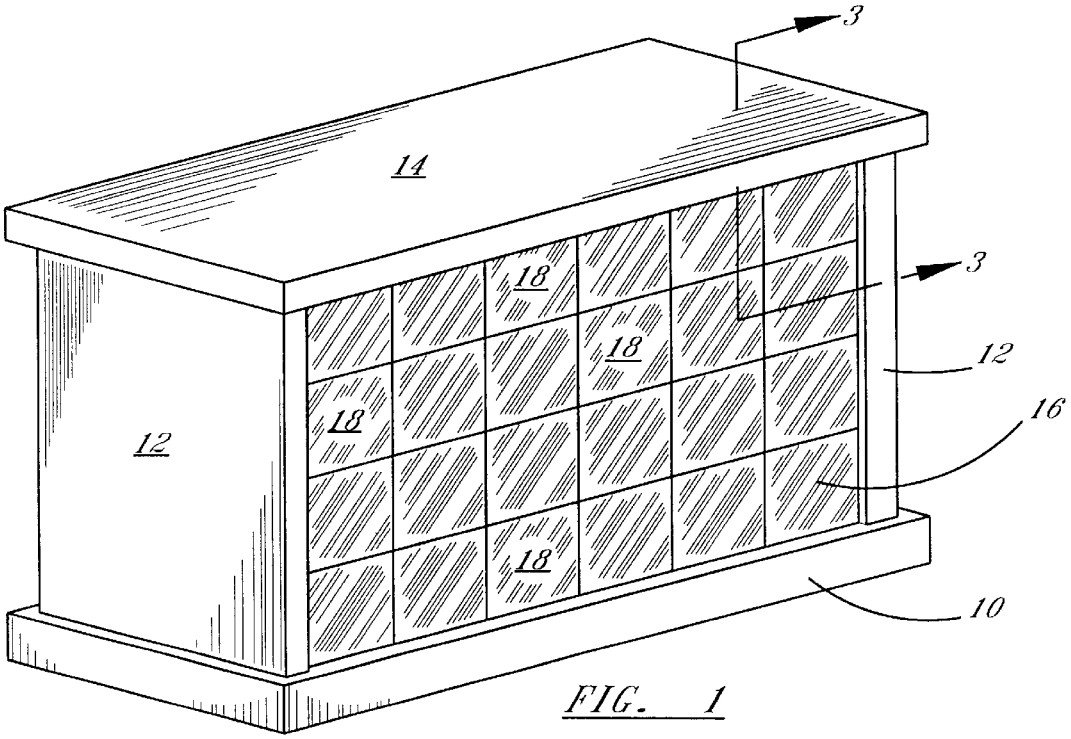
FIG. 1 is a perspective view of the outer structure of the columbarium of the invention.
Figure 2:
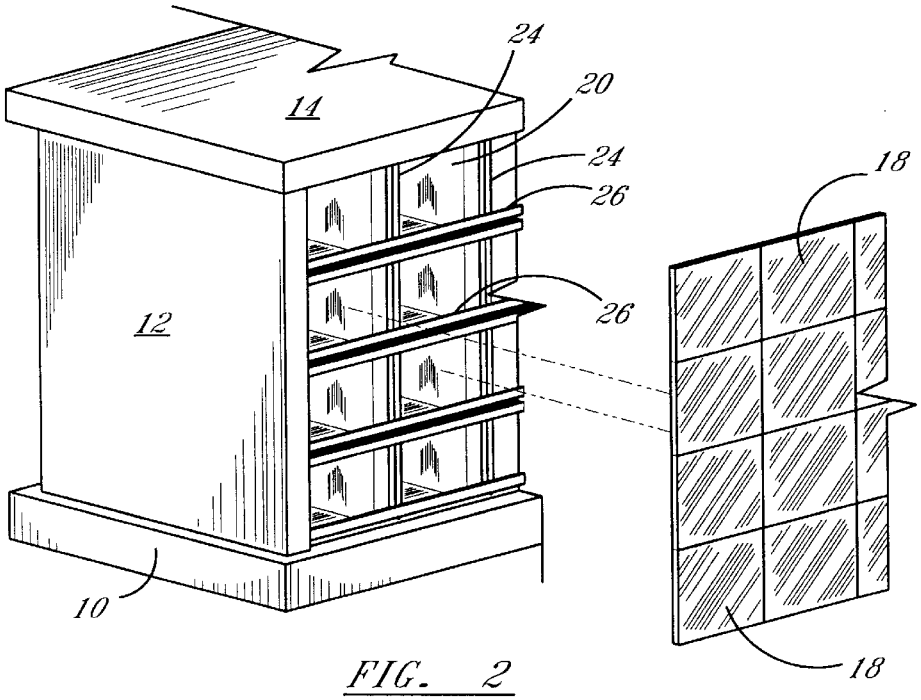
FIG. 2 is an exploded sectional perspective view, similar to FIG. 1 showing the frame structure.

FIG. 1 shows the preferred embodiment of the columbarium structure of the invention. The columbarium includes a base 10 which is formed of a unitary granite slab which is generally dimensioned to about 7'×3'×0.5'. A pair of end members 12 are positioned adjacent opposite ends of base 10 and extend vertically. Each end member is also preferably formed of a unitary granite slab generally dimensioned to about 2.67'×0.33'×4'. Top 14 is positioned atop the upper ends of ends 12 and in the same vertical plane as base 10. Top 14 is also a unitary granite slab dimensioned to be about 7'×3'×0.33'. These sizes are not mandatory and may be varied as desired, particularly in the length and height directions.

As shown in FIG. 1, the base ends and top are assembled with base 10 being the lower support structure, end 12 defining the longitudinal and vertical limits, and top 14 being the upper limit. The area circumscribed by these members is a completely open inner area which is intended to receive and stack individual containers.

A pair of side walls 16, only one of which is shown are located along the opposed side edges of base 10, ends 12 and top 14. Each side wall 16 is comprised of a plurality of cover plates or door panels 18 which are arranged in a plurality vertical and horizontal rows. The cover plates are formed of shaped stone, preferably granite pieces, which are sized to be about 12"×12"×⅜". The size of each cover plate 16 is such that the assembled plates form the side walls to substantially fill the opening or inner area formed by base 10, ends 12 and top 14. The outer face of cover plates 18 is preferably polished.

The inner area of the opening is filled with a plurality of containers 20 which are arranged in a plurality of horizontal rows and stacked vertical rows which substantially coincide with the horizontal and vertical rows formed by cover plates 18. Containers 20 are of usual construction and size and include a door. Normally they are arranged in two horizontal spaced rows back to back with the doors of each row facing a wall 16. A latch assembly is normally associated with each door. The containers and their arrangement within the columbarium are well known and form no part of the instant invention.

Figures 3, 4:
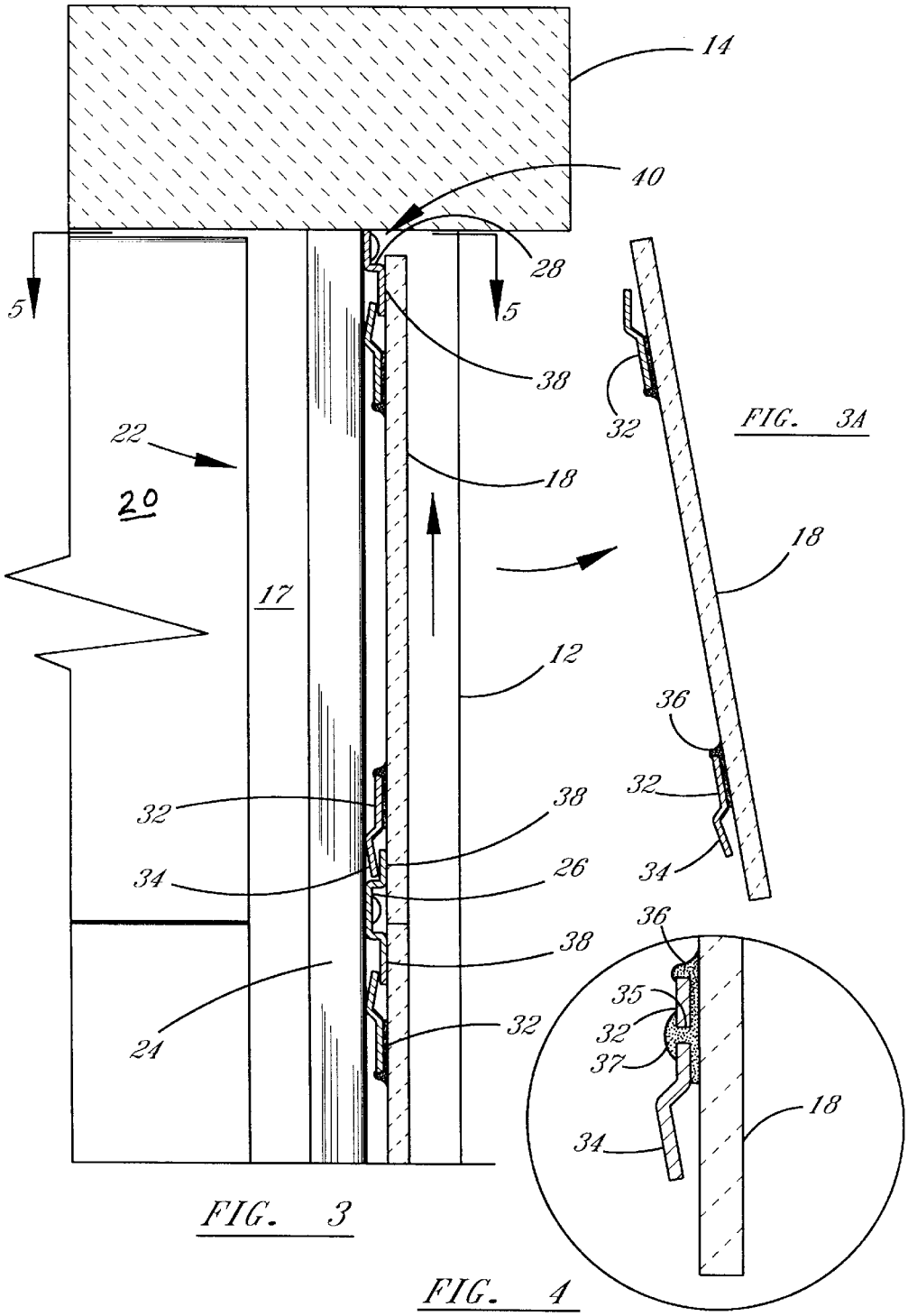
FIG. 3 is a sectional end view taken along lines 3—3 of FIG. 1.
FIG. 4 is an exploded end view showing the attachment strip of the cover plate.
Figure 5:
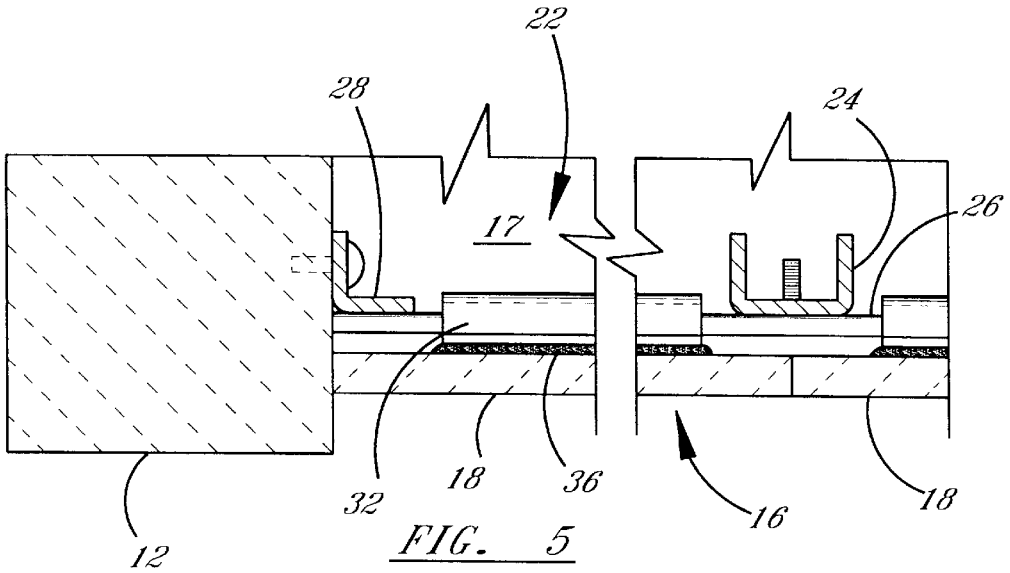
FIG. 5 is a sectional top view taken along lines 5—5 of FIG. 3.

A frame 22 is positioned to be spaced slightly outward from the outer or exposed ends of the stacked containers 20 forming opening 17, as seen in FIG. 3. Frame 22 is formed of horizontal metal rods 26 and vertical metal struts 24 which are aligned substantially along the planes formed by the adjacent sides of the stacked containers 20. Opposed ends of horizontal rods 26 are connected with inner surfaces of side members 12 as shown in FIG. 5. An L-shaped bracket 28 may be welded to the end of horizontal rod 26 and secured with the side wall be means of a bolt. Other means of attachment are satisfactory so long as horizontal rods 26 are securely connected with ends 12.

Vertical struts 24, which are aligned along the plane formed by the engaging sides of containers 20, are preferably secured with horizontal rods 26 by welding. Opposed ends of struts 24 may connect with inner surfaces of base 10 and top 14 by any suitable conventional means not shown.

Horizontal rods 26 are formed with outwardly flared upper and lower edges 38 as best seen in FIG. 3. Uppermost and lowermost horizontal rods 28 have their lower and upper edge flared outwardly as indicated at 38. It is noted that only the uppermost rod 28 is shown.

Cover plates 18 are each provided with spaced horizontal attachment strips 32 which are secured with the inner surface of cover plate 18 by any suitable means such as adhesive 36, which is preferably an epoxy resin. In order to insure a permanent seal, a plurality of small bores 35 are formed along the length of each strip 32. Adhesive 36 passes through bores 35 forming cap 37 on the outer site of the strip which mechanically locks strip 32 with the adhesive. The porosity of the stone allows sufficient penetration of adhesive 36 to securely lock it with cover plate 18. Outer edges of attachment strips 32 are flared outwardly as indicated at 34.

Attachment strips 32 are formed to extend substantially across the length of cover plates 18 as shown in FIG. 5 and are spaced vertically so that outer edges 34 extend slightly beyond the plane in which upper or lower edges 38 of horizontal rods 26 or 28 extend.

Each side wall 16 is installed in the following manner. The lower horizontal row of cover plates 16 is installed first. The flared end 34 of upper attachment strip 32 is positioned behind flared edge 38 of horizontal rod 26 and cover plate 18 is move slightly upward, as indicated by the arrow in FIG. 3, allowing flared lower edge 34 of lower attachment strip 32 to slide over upper flared edge 38 of the associated horizontal rod 28. Cover plate 18 is moved into a vertical position positioning outer edges 34 to be engaged behind upper and lower edges 38. Cover plate 18 is lowered until it rests on and is supported by base 10. Edges 34 are engaged behind edges 38, locking cover plate 18 in position.

The second and then the third horizontal row are installed in a similar manner with the cover plates 18 all resting on and being supported by the first and then the second row of cover plates.

The fourth and final row of cover plates is also similarly installed. Here, a slight gap 40 is provided between the upper edge of cover plate 18 and the inner surface of top 14. Flared edge 34 is positioned behind edge 38, the upper edge of the cover plate 18 is moved upwardly into gap 40 locating flared edge 34 of lower attachment strip 32 above upper edge 38 of the associated rod 26. Edge 34 may now slip over upper edge 38 of horizontal rod 26 vertically locating the cover plate. Cover plate 18 is lowered into contact with the upper edge of the cover plate below it and is locked in vertical position by frame 22.

Frame 22 does not function to support wall 16, it merely acts to retain each of the cover plates positioned along a single vertical plane and it acts to retain or lock them against intrusion.

While a preferred embodiment of the invention has been described using specific terms, such description is for illustrative purposes only, and it is to be understood that changes and variations may be made without departing from the spirit or scope of the following claims.

What is claimed is:

1. A columbarium having a horizontal stone base, vertical stone end walls, and a stone top forming an opening for housing a plurality of containers arranged side by side in vertical and horizontal rows, said columbarium including;

a pair of substantially vertically disposed side walls supported on said base and positioned within said opening adjacent outer ends of said container rows;

each said side wall comprising a plurality of removable stone cover plates arranged in side by side vertical and horizontal rows with individual of said plates being positioned opposite ends of individual of said containers; whereby, said cover plates forming the lower of said horizontal rows is supported on said base and in each succeeding of said horizontal rows said cover plates are supported on said cover plates forming the previous horizontal row.

2. The columbarium of claim 1 including a support frame positioned between said side walls and said container ends;

said support frame connecting with inner surfaces of said base, end walls and top.

3. The columbarium of claim 2 wherein said support frame includes interconnected horizontal rods and vertical struts arranged along planes which are substantially parallel with horizontal and vertical sides of said containers.

4. The columbarium of claim 3 wherein each said cover plate has a pair of attachment strips secured therewith, said attachment strips being adapted to attach with said frame to secure said cover plate along said vertical plane.

5. The columbarium of claim 4 wherein adjacent pairs of said horizontal rods include oppositely directed flared edges and said attachment strips include oppositely directed flared edges;

said strip flared edges being removably engageable behind said rod flared edges; whereby, said cover plates are removably held in vertical alignment opposite respective container ends.

6. A columbarium having an enclosed area formed by a pair of end walls disposed along substantially vertical planes resting on a base and supporting a top, said base and top being disposed along substantially horizontal planes;

a plurality of containers arranged in horizontal and vertical rows supported on said base within said enclosed area;

a pair of side walls disposed along substantially vertical planes, said side walls along with said end walls forming outer limits of said enclosed area;

a frame connected with inner faces of said end walls, said frame having a plurality of substantially horizontally disposed rods;

said side walls being formed of a plurality of removable cover plates having attachment members secured with one face thereof, said cover plates being arranged in horizontal and vertical rows substantially corresponding with the horizontal and vertical rows formed by said containers;

said vertical rows of said cover plates being supported on said base; and, said attachment members engaging with said horizontal rods to maintain said cover plates positioned along said vertical planes.

7. The columbarium of claim 6 wherein each said attachment member comprises an upper and lower metal strip, each said strip having a flared horizontal edge.

8. The columbarium of claim 7 wherein said rods have outwardly flared upper and lower edges, said flared rod edges being adapted to engage behind said flared strip edges locking said plate in vertical position.

9. The columbarium of claim 6 wherein said frame includes vertical support struts connected with said horizontal rods and with the inner surface of said top and said base.

10. The columbarium of claim 9 wherein said struts and rods are positioned to extend along planes formed by engaging sides of said containers.

11. A cover plate for use with a columbarium:

said cover plate being formed of a stone piece having an inner and outer-face and sized to be about ⅜" wide and of desired length and height;

a pair of substantially identical attachment strips, of a length slightly less than the length of said cover plate, secured along said inner face in vertically spaced parallel relationship each said attachment strip having an outwardly directed flared edge directed toward and being parallel with a respective of opposed upper and lower edges of said cover plate, and, an adhesive securing said attachment strips with said inner face.

12. The cover plate of claim 11 including a plurality of spaced bores formed along said attachment strips, said adhesive passing through said bores of said attachment strips and form securing caps on a second side thereof.

* * * * *